US008049125B2

(12) United States Patent
Huang et al.

(10) Patent No.: US 8,049,125 B2
(45) Date of Patent: Nov. 1, 2011

(54) KEY STRUCTURE

(75) Inventors: Chien-Hsin Huang, Taoyuan (TW); Fu-Long Hong, Taoyuan (TW); Yi-Bin Ho, Taoyuan (TW)

(73) Assignee: HTC Corporation, Taoyuan, Taoyuan County (TW)

( * ) Notice: Subject to any disclaimer, the term of this patent is extended or adjusted under 35 U.S.C. 154(b) by 389 days.

(21) Appl. No.: 12/340,831

(22) Filed: Dec. 22, 2008

(65) Prior Publication Data

US 2009/0167510 A1 Jul. 2, 2009

(30) Foreign Application Priority Data

Dec. 26, 2007 (TW) ..... 96150351 A

(51) Int. Cl.
*H01H 13/70* (2006.01)

(52) U.S. Cl. ..... 200/341; 200/5 A

(58) Field of Classification Search ..... 341/22; 345/168, 169; 400/472, 473, 486–489; 455/95, 455/556.2, 157.2, 158.5; 200/5 A, 511–517, 200/341

See application file for complete search history.

(56) References Cited

U.S. PATENT DOCUMENTS

| | | | | |
|---|---|---|---|---|
| 5,940,015 | A * | 8/1999 | Thornton et al. | 341/20 |
| 6,207,912 | B1 * | 3/2001 | Persson | 200/305 |
| 6,274,825 | B1 * | 8/2001 | Aaltonen et al. | 200/5 A |
| 6,750,414 | B2 * | 6/2004 | Sullivan | 200/512 |
| 6,876,354 | B1 * | 4/2005 | Terasaki et al. | 345/168 |
| 6,879,317 | B2 * | 4/2005 | Quinn et al. | 345/168 |
| 6,911,608 | B2 | 6/2005 | Levy | |
| 7,106,222 | B2 * | 9/2006 | Ward et al. | 341/34 |
| 7,388,576 | B2 * | 6/2008 | Griffin et al. | 345/168 |
| 7,525,534 | B2 * | 4/2009 | Skillman et al. | 345/168 |
| 7,572,900 | B2 * | 8/2009 | Strasser et al. | 536/23.1 |
| 7,711,256 | B2 * | 5/2010 | Wun | 396/56 |
| 7,741,570 | B2 * | 6/2010 | Yurochko et al. | 200/5 A |
| 2005/0190160 | A1 | 9/2005 | Wang et al. | |

(Continued)

FOREIGN PATENT DOCUMENTS

EP 0546468 12/1992

(Continued)

OTHER PUBLICATIONS

English language translation of abstract of TW 587888 (published May 11, 2004).

(Continued)

*Primary Examiner* — Michael Friedhofer
(74) *Attorney, Agent, or Firm* — Thomas|Kayden

(57) ABSTRACT

A key structure including at least two protruding keys and a key frame is provided. The at least two protruding keys are arrayed adjacently. Each of the at least two protruding keys has a first side edge, a second side edge and a protrusion. The second side edge is opposite to the first side edge. The protrusion has a curved-convex surface, a first side surface and a second side surface. The curved-convex surface is getting protruding inwardly from the first side edge and the second side edge. The top end of the curved-convex surface has a crest line. The first side surface passes through the end points of the first side edge, the second side edge and the crest line in the same side. The second side surface is opposite to the first side surface. The key frame is used for carrying the at least two protruding keys.

15 Claims, 5 Drawing Sheets

U.S. PATENT DOCUMENTS

| | | | |
|---|---|---|---|
| 2006/0126825 | A1 | 6/2006 | Faust |
| 2006/0202968 | A1 | 9/2006 | Skillman et al. |

FOREIGN PATENT DOCUMENTS

| | | |
|---|---|---|
| GB | 2291837 | 2/1996 |
| GB | 2353762 | 3/2001 |
| GB | 2 353 762 | 7/2001 |
| JP | 2001135193 | 5/2001 |
| TW | 587888 | 5/2004 |
| WO | 9949486 | 9/1999 |
| WO | 9949486 | 4/2009 |

OTHER PUBLICATIONS

English language translation of abstract of JP 2001135193 (published May 18, 2001).
English abstract of EP0546468.

* cited by examiner

KEY STRUCTURE

This application claims the benefit of Taiwan application Serial No. 96150351, filed Dec. 26, 2007, the subject matter of which is incorporated herein by reference.

BACKGROUND OF THE INVENTION

1. Technical Field

The application relates in general to a key structure, and more particularly to a key structure providing better touching and recognition.

2. Description of the Related Art

Electronic devices such as personal digital assistant (PDA) and mobile phone are very popular nowadays. An ordinary electronic device, such as a PDA, normally has many keys disposed on the front surface of the body of the electronic device for the user's convenience of operating the electronic device.

As electronic devices are getting smaller, lighter, thinner and shorter, the available space on the front surface is very limited, the keys are miniaturized and getting smaller. With respect to the miniaturized keys, the fingers are too big. As a consequence, the recognition of the key for the user deteriorates and the user easily touch other undesired keys.

SUMMARY OF THE INVENTION

The application is directed to a key structure. The design of a crest line disposed on the curved-convex surface of a key provides better recognition for the finger when the finger touches the key. Particularly, when the adjacent keys are small keys, the curved-convex surface 114 avoids the adjacent keys being touched unintentionally.

According to a first aspect of the application, a key structure including at least two protruding keys and a key frame is provided. The at least two protruding keys are arrayed adjacently. Each of the at least two protruding keys has a first side edge, a second side edge and a protrusion. The second side edge is opposite to the first side edge. The protrusion has a curved-convex surface, a first side surface and a second side surface. The curved-convex surface is getting protruding inwardly from the first side edge and the second side edge. The top end of the curved-convex surface has a crest line. The first side surface passes through the end points of the first side edge, the second side edge and the crest line in the same side. The second side surface is opposite to the first side surface. The key frame is used for carrying the at least two protruding keys.

The application will become apparent from the following detailed description of the preferred but non-limiting embodiments. The following description is made with reference to the accompanying drawings.

DETAILED DESCRIPTION OF THE INVENTION

Figure 1A:
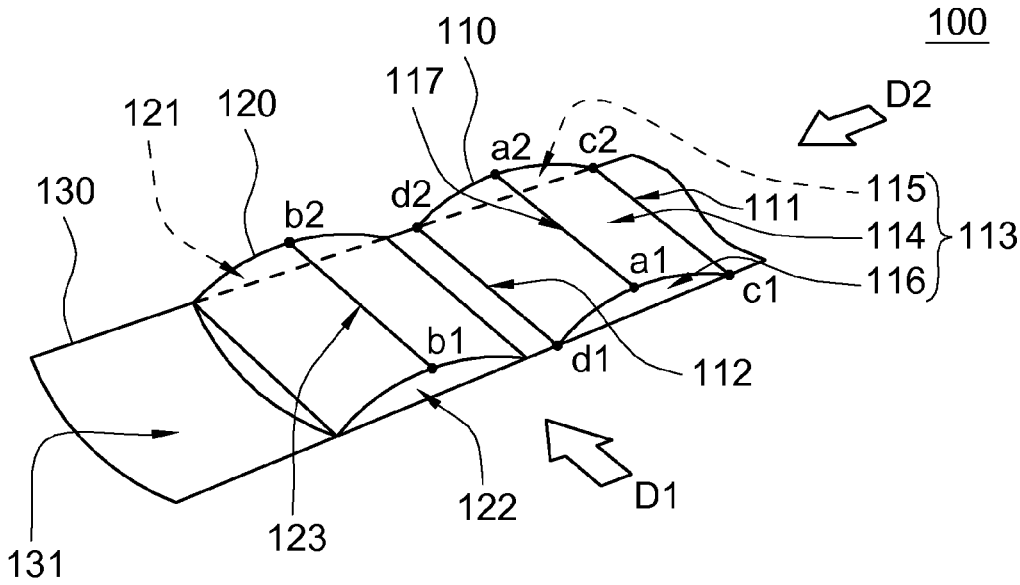
FIG. 1A shows a key structure according to a preferred embodiment of the invention.

Referring to FIG. 1A, a key structure according to a preferred embodiment of the invention is shown. The key structure 100 includes at least two protruding keys and a key frame 130. The at least two protruding keys are a protruding key 110 and a protruding key 120. The protruding key 110 and the protruding key 120 are arrayed adjacently. The protruding key 110 has a first side edge 111, a second side edge 112 and a protrusion 113. The second side edge 112 is opposite to the first side edge 111. The protrusion 113 has a curved-convex surface 114, a first side surface 115 and a second side surface 116. The curved-convex surface 114 is getting protruding inwardly from the first side edge 111 and the second side edge 112. The top end of the curved-convex surface 114 has a crest line 117. The curved-convex surface 114 is a cambered surface, a cylindrical surface or an elliptic cylindrical surface. The crest line 117 is located at the top of the mentioned geomery surfaces. The first side surface 115 passes through the end points c2, d2 and a2 of the first side edge 111, the second side edge 112 and the crest line 117 in the same side. The second side surface 116 passes through the end points c1, d1 and a1 of the first side edge 111, the second side edge 112 and the crest line 117 in the other side. The second side surface 116 is opposite to the first side surface 115. The key frame 130 is used for carrying the protruding key 110 and the protruding key 120.

Figure 1B:
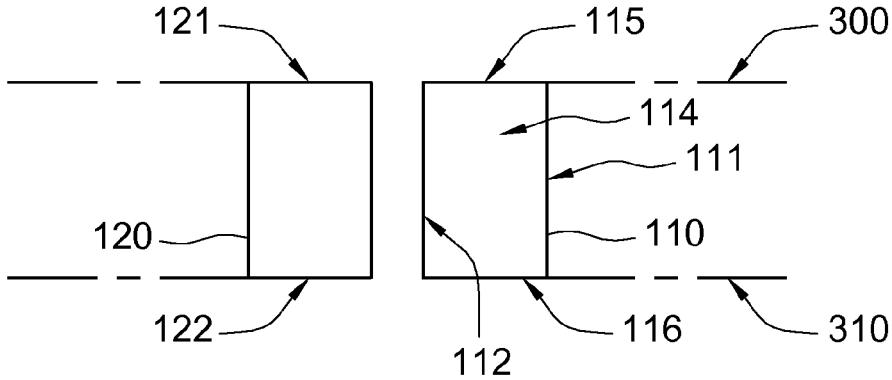
FIG. 1B shows a top view of a protruding key of FIG. 1A.

Referring to FIG. 1B, a top view of a protruding key of FIG. 1A is shown. The first side edge and the second side edge are substantially parallel to each other. The first side surfaces 115 and 121 of the protruding keys 110 and 120 substantially are located at the same plane 300, and the second side surfaces 116 and 122 of the protruding keys 110 and 120 are also substantially located at the same plane 310, such that the protruding keys 110 have a rectangular contour and look more regular from a top view.

However, the adjacent protruding keys do not necessarily have the same shape. For example, with the ratio of the first side edge vs. the second side edge being appropriately adjusted, each of the protruding keys can be squared, rectangular or diamond-shaped when looked from a top view. Or, there is a contained angle between the first side edge and the second side edge, and make the protruding key look like a trapezoid (not illustrated) from a top view. Thus, various appearances can be created.

Figure 2:
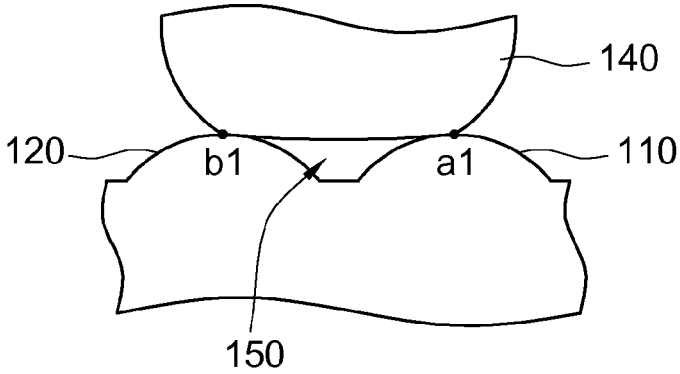
FIG. 2 shows a finger touching the protruding key of FIG. 1A viewed from the direction D1.

Referring to FIG. 2, a finger touching the protruding key of FIG. 1A viewed from the direction D1 is shown. The top ends of the protruding key 110 and the protruding key 120 respectively have the crest line 117 and the crest line 121. That is, the crest line is located at the topmost point of the protruding key. From a mathematical point of view, the curved-convex surfaces of the protruding keys are constituted by a non-continual surface. When the finger 140 touches the protruding key 110, the finger 140 actually touches the crest line 117 and the crest line 121 respectively, and such touching enables the finger 140 to have better recognition for the protruding key 110. Thus, it is less likely that the user would touch undesired keys unintentionally.

Also, a groove 150 is formed between two protruding keys 110 for providing an appropriate space. When the user position a target key and presses downward from the crest line 117 of the target key, the finger will not press any adjacent keys due to the design of the appropriate space. Particularly, when the adjacent keys are small keys (for example, the width of two adjacent keys is smaller than the width of the finger), the curved-convex surface 114 avoids the adjacent keys being touched unintentionally.

Figure 3:
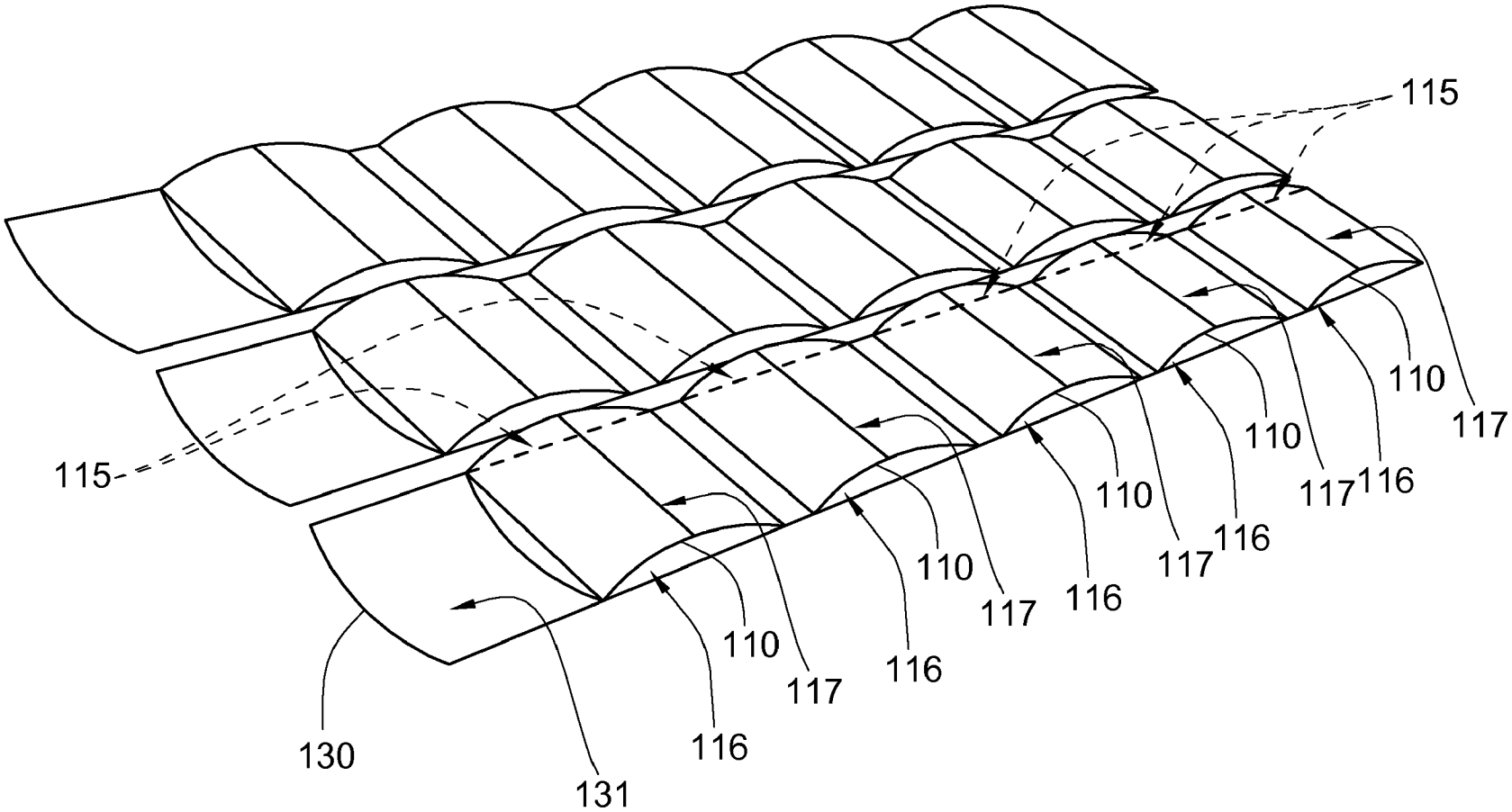
FIG. 3 shows a plurality of protruding keys.

In the present embodiment of the invention, the number of protruding keys is two. However, in other embodiments, the number of the protruding key can be more than two. Referring to FIG. 3, a plurality of protruding keys is shown. The protruding keys 110 are arranged adjacently. The crest lines 117 of the protruding keys 110 are substantially parallel to each other, and the first side surface 115 and the second side surface 116 are substantially located at the same plane, such that the protruding keys 110 are arranged in a matrix and look more regular.

Figure 4:
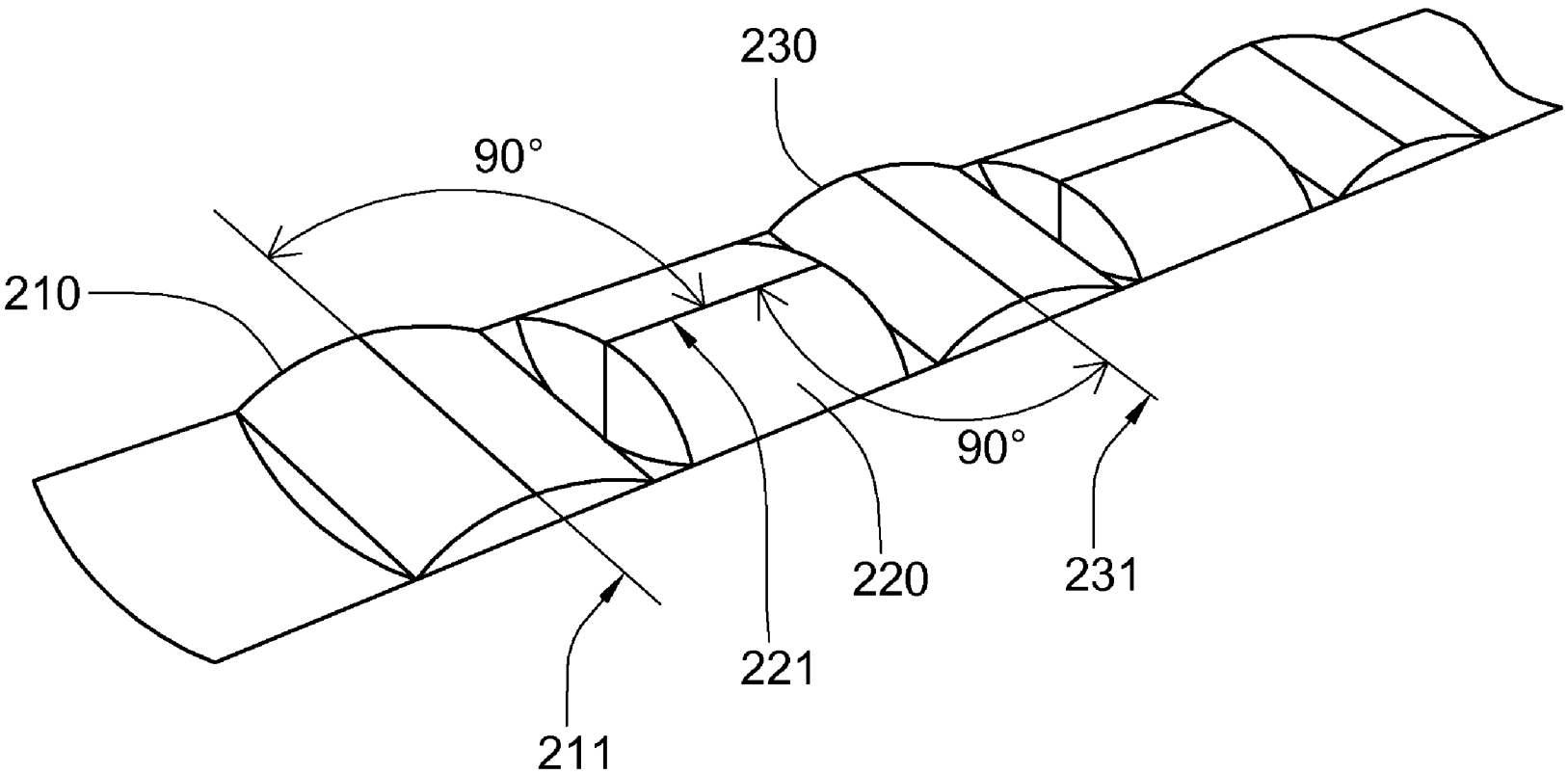
FIG. 4 shows the crest lines of the protruding keys of FIG. 3 arranged at an angle of 90 degrees with one another.

Apart from being arranged in parallel, the crest lines can also be arranged in other forms as indicated in other embodiments. For example, the crest line can be alternately arranged at an angle of any degrees, and many different arrangements of the protruding key can be derived from this concept. Referring to FIG. 4, the crest lines of the protruding keys of FIG. 3 arranged at an angle of 90 degrees with one another is shown. The crest lines of two adjacent protruding keys are arranged at an angle of 90 degrees with each other. To be more precisely, the angle between the crest line 221 of the protruding key 220 and the crest line 211 of the adjacent protruding key 210 is 90 degrees, and the angle between the crest line 221 of the protruding key 220 and the crest line 231 of the adjacent protruding key 230 is 90 degrees.

Figure 5:
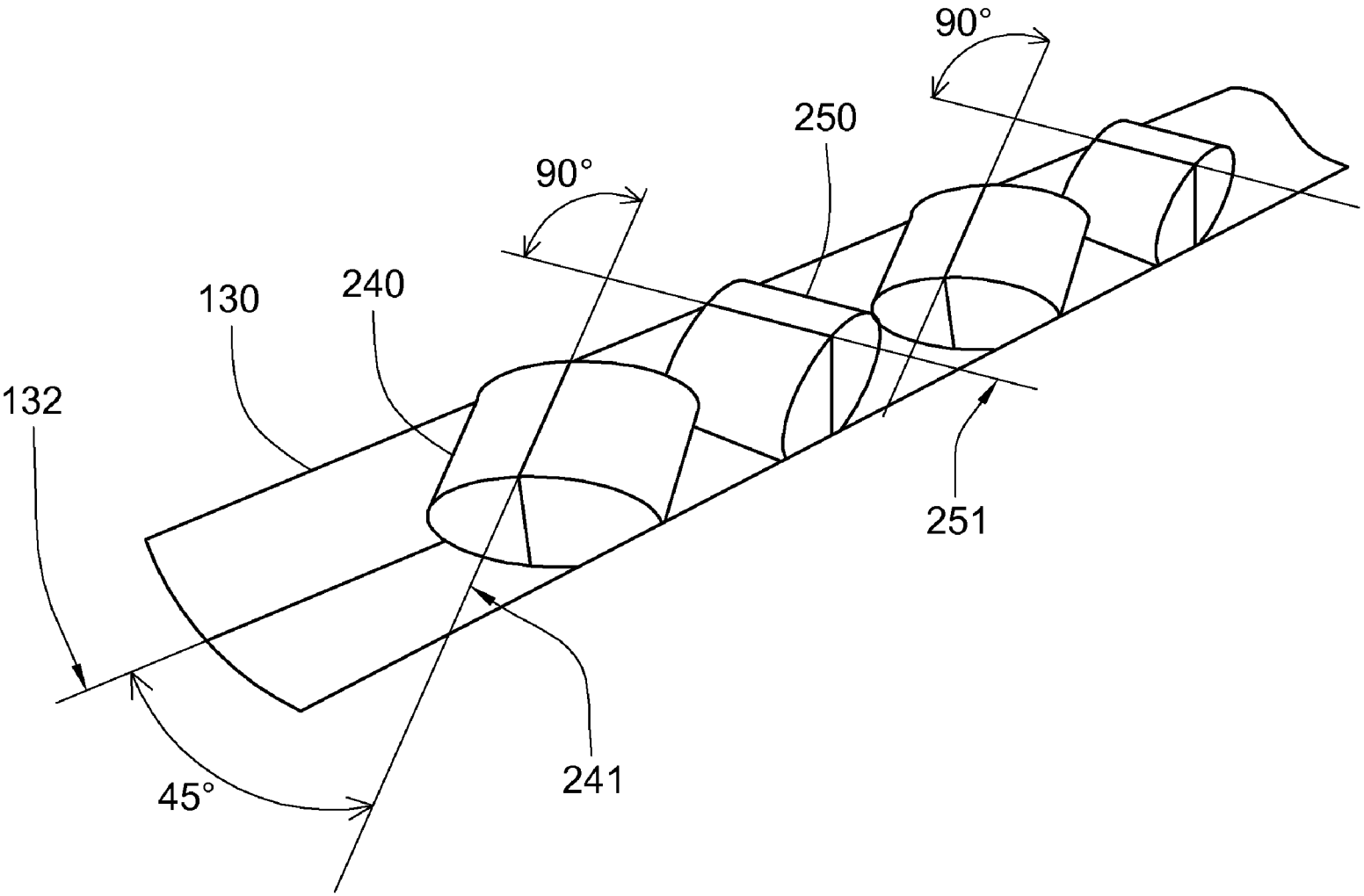
FIG. 5 shows the crest line of the protruding key of FIG. 3 arranged at an angle of 45 degrees to the center line of the key frame.

In other embodiment, the crest lines 117 can also be arranged at an angle to the center line of the key frame 130, wherein the angle can be of any degrees, and many different arrangements of the protruding key can be derived from this concept. Referring to FIG. 5, the crest line of the protruding key of FIG. 3 arranged at an angle of 45 degrees to the center line of the key frame is shown. The crest line 241 is arranged at an angle of 45 degrees to the center line 132 of the key frame 130, but each two of the crest lines of the protruding keys are arranged at an angle of 90 degrees. As indicated in FIG. 5, the crest line 241 and the crest line 251 are arranged at an angle of 90 degrees.

In the present embodiment of the invention, the arrangement between every two protruding keys is not limited to the above arrangements. For example, the crest line of one protruding key can be perpendicular or parallel to the crest line of one adjacent protruding key and arranged at an angle of any degrees to the crest line of the other adjacent protruding key. Or, in one entire row, the crest lines of every two adjacent protruding keys are parallel or perpendicular to each other, and in another row, the crest line of the protruding key are arranged in a another form. Or, in one entire row, the crest lines of every two adjacent protruding keys are arranged at different angles, and in another row, the protruding keys are arranged in another form.

Referring to FIG. 1A and FIG. 3, the key frame 130 has a plurality of recesses 131 for accommodating the protruding key 110. As the elevated height of the protruding key 110 disposed in the recess 131 is lower than that not disposed in the recess 131, the protruding key 110 can be flatly disposed on an electronic device such as a mobile phone or a PDA, such that the electronic device is even more thinned. Meanwhile, the recess can be combined with the protruding key to form an accommodating recess with cambered surface, and make the design of the key structure more integrated.

Figure 6A:
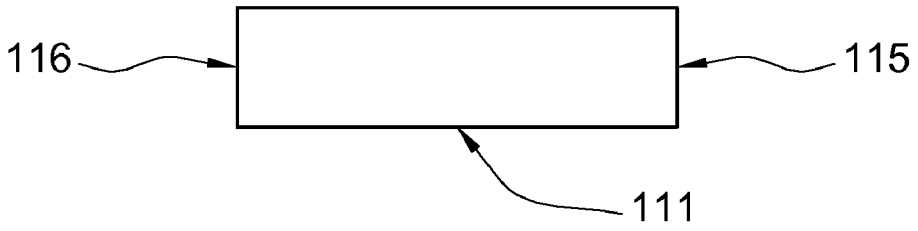
FIGS. 6A-6C show various contours of the protruding key of FIG. 1A viewed from the direction D2.
Figure 6B:
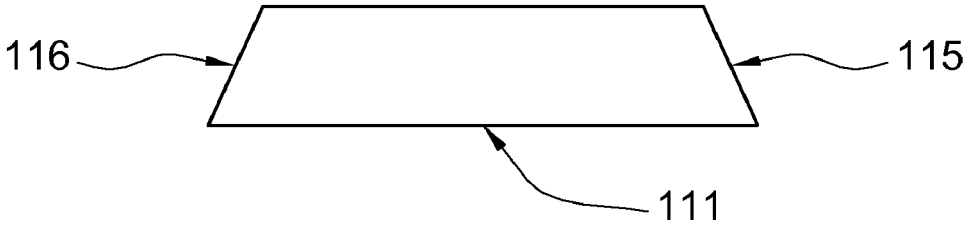
Figure 6C:
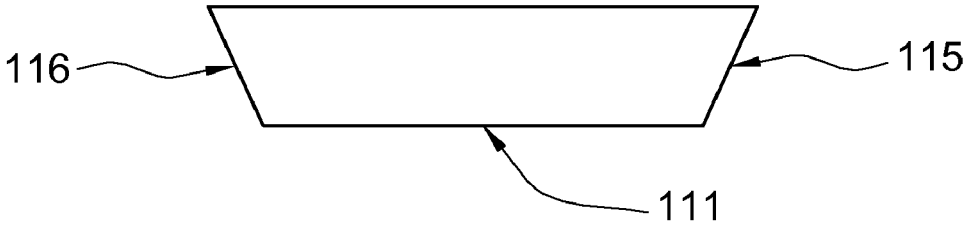

Referring to FIGS. 6A-6C, various contours of the protruding key of FIG. 1A viewed from the direction D2 are shown. The first side surface 115 and the second side surface 116 can be arranged at a contained angle or substantially in parallel, so as to create different appearances of the protruding keys. The first side surface and the second side surface create a rectangular shape as indicated in FIG. 6A, and create a trapezoid as indicated in FIGS. 6B-6C.

According to the key structure disclosed in the embodiments of the invention, the design of the crest line on the protruding key provides better touching and recognition for the finger when touching the protruding key. More importantly, the application breaks the conventional design that the surface of the key is a curved surface such as a spherical surface, a cambered surface or a planar surface, and replaces the conventional key having a curved surface with a new key having a non-continual surface. The design of the application not only possesses a more attractive appearance and superior functions but also provides better recognition and touching than the conventional curved-surface QWERTY keys. When the finger presses the key of the application, the finger can easily differentiate the target from its adjacent keys, and will not touch an undesired key unintentionally. Meanwhile, structural change also occurs to the bottom of the protruding key and the key frame surface (such as a recess) used for carrying the key, that is, the bottom of the key and the key frame surface can form a continual or non-continual surface (the key is protruded and the recess is indented). With such a structural change, the elevated height of the protruding key from the surface of the hand-held device can be effectively reduced, so as to reduce the fraction between the key and external environment and avoid unnecessary damages.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A key structure, comprising:

at least two protruding keys arrayed adjacently, each the at least two protruding keys has:

a first side edge;

a second side edge opposite to the first side edge; and a protrusion, having:

a curved-convex surface getting protruding inwardly from the first side edge and the second side edge, wherein the top end of the curved-convex surface has a crest line, the curved-convex surface has a non-continual surface at the crest line;

a first side surface passing through the end points of the first side edge, the second side edge and the crest line in the same side; and a second side surface passing through the end points of the first side edge, the second side edge and the crest line in the other side, wherein the second side surface is opposite to the first side surface; and a key frame used for carrying the at least two protruding keys.

2. The key structure according to claim 1, wherein the contour of each of the curved-convex surfaces is a cambered surface, a cylindrical surface or an elliptic cylindrical surface.

3. The key structure according to claim 1, wherein a groove is formed between the at least two protruding keys.

4. The key structure according to claim 1, wherein the crest lines are substantially parallel to each other.

5. The key structure according to claim 1, wherein the crest lines are alternately arranged at a contained angle.

6. The key structure according to claim 5, wherein the contained angle is 90 degrees.

7. The key structure according to claim 1, wherein at least one of the first side surfaces and the second side surfaces substantially are located at the same plane.

8. The key structure according to claim 1, wherein the first side edge and the second side edge are substantially parallel to each other.

9. The key structure according to claim 1, wherein there is a contained angle between the first side edge and the second side edge.

10. The key structure according to claim 1, wherein the keyboard frame has at least two recesses used for accommodating the at least two protruding keys.

11. The key structure according to claim 10, wherein each of the at least two recesses forms an accommodating recess having a cambered surface.

12. The key structure according to claim 1, wherein the first side surface and the second side surface are substantially parallel to each other.

13. The key structure according to claim 1, wherein there is a contained angle between the first side surface and the second side surface.

14. The key structure according to claim 1, the key structure is used in a mobile phone or a personal digital assistant (PDA).

15. The key structure according to claim 1, wherein the curved-convex surfaces can be constituted by a non-continual surface.

* * * * *